US010618275B2

(12) United States Patent
Tsuji

(10) Patent No.: US 10,618,275 B2
(45) Date of Patent: Apr. 14, 2020

(54) INKJET RECORDING APPARATUS AND RECORDING HEAD POSITION ADJUSTMENT METHOD

(71) Applicant: KYOCERA Document Solutions Inc., Osaka (JP)

(72) Inventor: Kikunosuke Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/058,434

(22) Filed: Aug. 8, 2018

(65) Prior Publication Data

US 2019/0054737 A1 Feb. 21, 2019

(30) Foreign Application Priority Data

Aug. 18, 2017 (JP) ..... 2017-157933

(51) Int. Cl.
*B41J 2/045* (2006.01)
*B41J 2/21* (2006.01)
*B41J 25/00* (2006.01)

(52) U.S. Cl.
CPC ..... *B41J 2/04505* (2013.01); *B41J 2/04586* (2013.01); *B41J 2/2146* (2013.01); *B41J 25/001* (2013.01); *B41J 25/003* (2013.01)

(58) Field of Classification Search
CPC .. B41J 2/04505; B41J 2/04586; B41J 2/2146; B41J 25/001; B41J 25/003
See application file for complete search history.

(56) References Cited

U.S. PATENT DOCUMENTS 8,419,160 B2 * 4/2013 Mantell ..... B41J 2/2139 347/19
9,156,267 B2 10/2015 Tanda
(Continued)

FOREIGN PATENT DOCUMENTS

CN 104589797 B 8/2016
JP 2003-127352 A 5/2003

OTHER PUBLICATIONS

Office Action mailed by the State Intellectual Property Office of the People's Republic of China dated Dec. 26, 2019, which corresponds to Chinese Patent Application No. 201810894111.X and is related to U.S. Appl. No. 16/058,434.

*Primary Examiner* — Thinh H Nguyen
(74) *Attorney, Agent, or Firm* — Studebaker & Brackett PC

(57) ABSTRACT

An inkjet recording apparatus includes recording heads and a head base. The recording heads include a first recording head, a second recording head, a third recording head, and a fourth recording head. The first to fourth recording heads each include three segment recording heads. The segment recording heads eject ink on to paper. The head base supports the 12 segment recording heads. One segment recording head among the 12 segment recording heads is selected as a reference head. The segment recording heads other than the reference head among the 12 segment recording heads are arranged such that longitudinal directions of the segment recording heads other than the reference head are parallel to a longitudinal direction of the reference head. The head base is arranged such that the longitudinal direction of the reference head is orthogonal to a conveyance direction of the paper.

9 Claims, 8 Drawing Sheets

(56) References Cited

U.S. PATENT DOCUMENTS

| | | | | |
|---|---|---|---|---|
| 2005/0156963 | A1* | 7/2005 | Song | B41J 2/04505 347/9 |
| 2010/0182371 | A1* | 7/2010 | Tomoguchi | B41J 2/16585 347/32 |
| 2015/0116422 | A1 | 4/2015 | Tanda | |

* cited by examiner

INKJET RECORDING APPARATUS AND RECORDING HEAD POSITION ADJUSTMENT METHOD

INCORPORATION BY REFERENCE

The present application claims priority under 35 U.S.C. § 119 to Japanese Patent Application No. 2017-157933, filed on Aug. 18, 2017. The contents of this application are incorporated herein by reference in their entirety.

BACKGROUND

The present disclosure relates to an inkjet recording apparatus and a recording head position adjustment method.

An inkjet recording apparatus includes a plurality of head units. Each head unit includes a plurality of lineheads. Overlap of the head units in a width direction of a recording medium is adjusted by moving the head units in the width direction.

SUMMARY

An inkjet recording apparatus according to an aspect of the present disclosure includes a plurality of recording heads and a head base. The recording heads eject ink on to a recording medium. The head base supports the recording heads. One recording head among the recording heads is selected as a reference head. The recording heads other than the reference head among the plurality of recording heads are arranged such that longitudinal directions of the recording heads other than the reference head are parallel to a longitudinal direction of the reference head. The head base is arranged such that the longitudinal direction of the reference head is orthogonal to a conveyance direction of the recording medium.

A recording head position adjustment method for implementation by an inkjet recording apparatus according to an aspect of the present embodiment includes selecting, primarily arranging, and secondarily arranging. The inkjet recording apparatus includes a plurality of recording heads and a head base. The recording heads eject ink on to a recording medium. The head base supports the recording heads. In the selecting, one recording head among the recording heads is selected as a reference head. In the primarily arranging, the recording heads other than the reference head among the plurality of recording heads are arranged such that longitudinal directions of the recording heads other than the reference head are parallel to a longitudinal direction of the reference head. In the secondarily arranging, the head base is arranged such that the longitudinal direction of the reference head is orthogonal to a conveyance direction of the recording medium.

BRIEF DESCRIPTION OF THE DRAWINGS

FIG. 5A is a perspective view illustrating the first fixing member. FIG. 5B is a cross-sectional view of the first fixing member taken along line VB-VB in FIG. 5A.

DETAILED DESCRIPTION

An embodiment of the present disclosure will be described as follows with reference to the drawings (FIGS. 1 to 8). Note that elements within the drawings that are the same or equivalent will be referred to with the same reference numbers and descriptions thereof will not be repeated.

Figure 1:
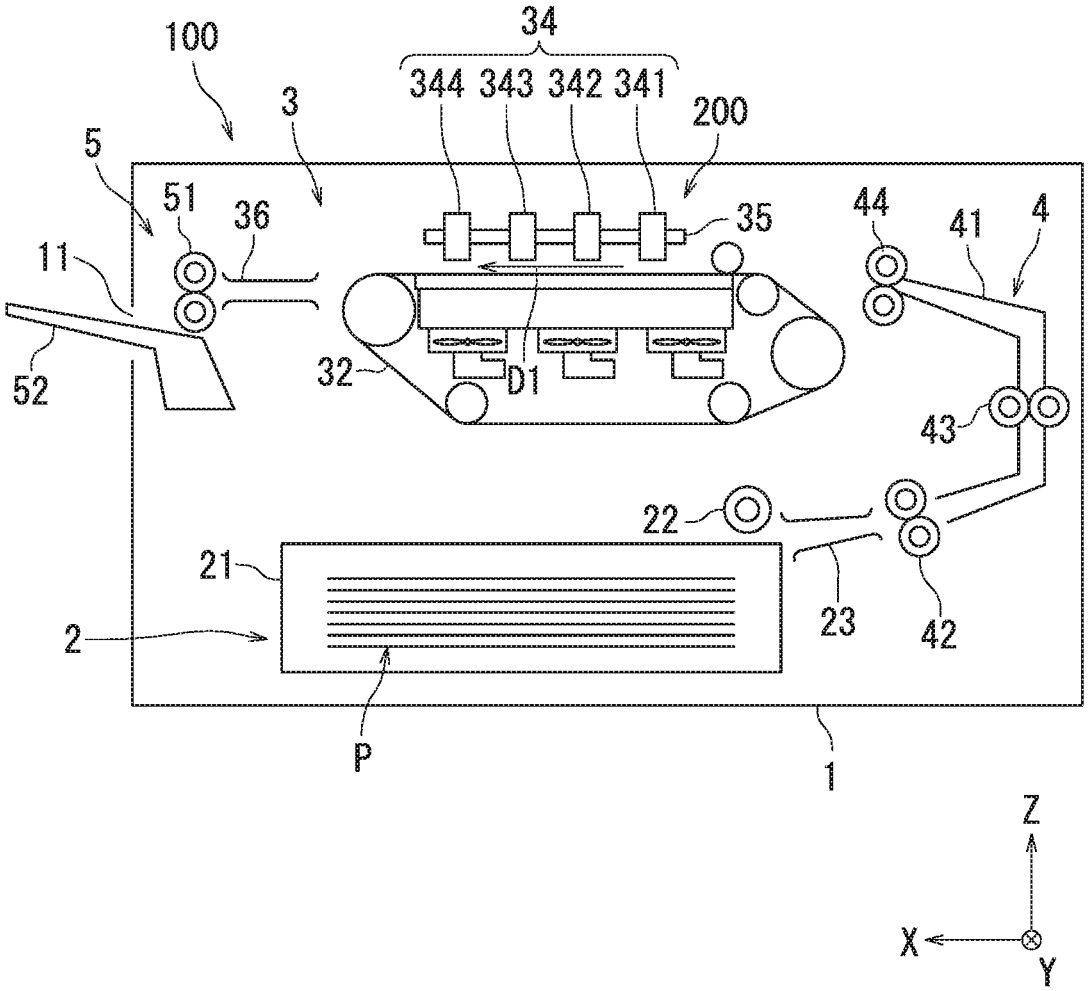
FIG. 1 is a side view illustrating a configuration of an inkjet recording apparatus according to an embodiment of the present disclosure.

First, an inkjet recording apparatus 100 according to the present embodiment will be described with reference to FIG. 1. FIG. 1 is a side view illustrating a configuration of the inkjet recording apparatus 100. Mutually orthogonal X, Y, and Z axes are shown in FIG. 1. The Z axis extends in a vertical direction. The X and Y axes extend in horizontal directions.

As illustrated in FIG. 1, the inkjet recording apparatus 100 includes a casing 1, a feeding section 2, an image forming section 3, a paper conveyance section 4, and an ejection section 5. The casing 1 houses the feeding section 2, the image forming section 3, the paper conveyance section 4, and the ejection section 5. The casing 1 has an exit port 11.

The feeding section 2 is in a lower (negative direction of the Z axis) inner portion of the casing 1. The feeding section 2 includes a paper feed cassette 21, a sheet feed roller 22, and a guide plate 23. The paper feed cassette 21 houses paper P and is freely attachable to and detachable from the casing 1. The feeding section 2 feeds the paper P to the paper conveyance section 4. The paper P is equivalent to an example of a "recording medium".

The paper conveyance section 4 is located to one side (negative direction of the X axis) of the image forming section 3. The paper conveyance section 4 includes a paper conveyance path 41, a first conveyance roller pair 42, a second conveyance roller pair 43, and a registration roller pair 44. The registration roller pair 44 sends the paper P to the image forming section 3 at a timing of image formation.

The image forming section 3 is above (positive direction of the Z axis) the feeding section 2. The image forming section 3 forms an image on the paper P. The image forming section 3 includes a head section 200, a conveyor belt 32, and a conveyance guide 36. The head section 200 includes a recording head 34 and a head base 35. The recording head 34 includes a first recording head 341, a second recording head 342, a third recording head 343, and a fourth recording head 344. The first to fourth recording heads 341 to 344 are equivalent to an example of a "plurality of recording heads".

A yellow ink Ky is housed in the first recording head 341. Yellow is equivalent to an example of a "first color". A black ink Kk is housed in the second recording head 342. Black is equivalent to an example of a "second color". A cyan ink Kc is housed in the third recording head 343. Cyan is equivalent to an example of a "third color". A magenta ink Km is housed in the fourth recording head 344. Magenta is equivalent to an example of a "fourth color".

The head base 35 supports the first to fourth recording heads 341 to 344. The head base 35 is flatly plate-shaped. The head base 35 is arranged parallel to an X-Y plane.

The conveyor belt 32 conveys the paper P fed from the registration roller pair 44 in a conveyance direction D1 of the paper P. The conveyance direction D1 of the paper P coincides with a positive direction of the X axis. The conveyance guide 36 is located to the other side (positive direction of the X axis in FIG. 1) of the image forming section 3. The conveyance guide 36 guides the paper P ejected from the conveyor belt 32 to the ejection section 5.

The ejection section 5 is located downstream in the conveyance direction D1 (positive direction of the X axis) of the paper P relative to the image forming section 3. The ejection section 5 includes an ejection roller pair 51 and an exit tray 52. The ejection roller pair 51 ejects the paper P out of the casing 1 through the exit port 11. The paper P ejected by the ejection roller pair 51 is placed on the exit tray 52.

Figure 2:
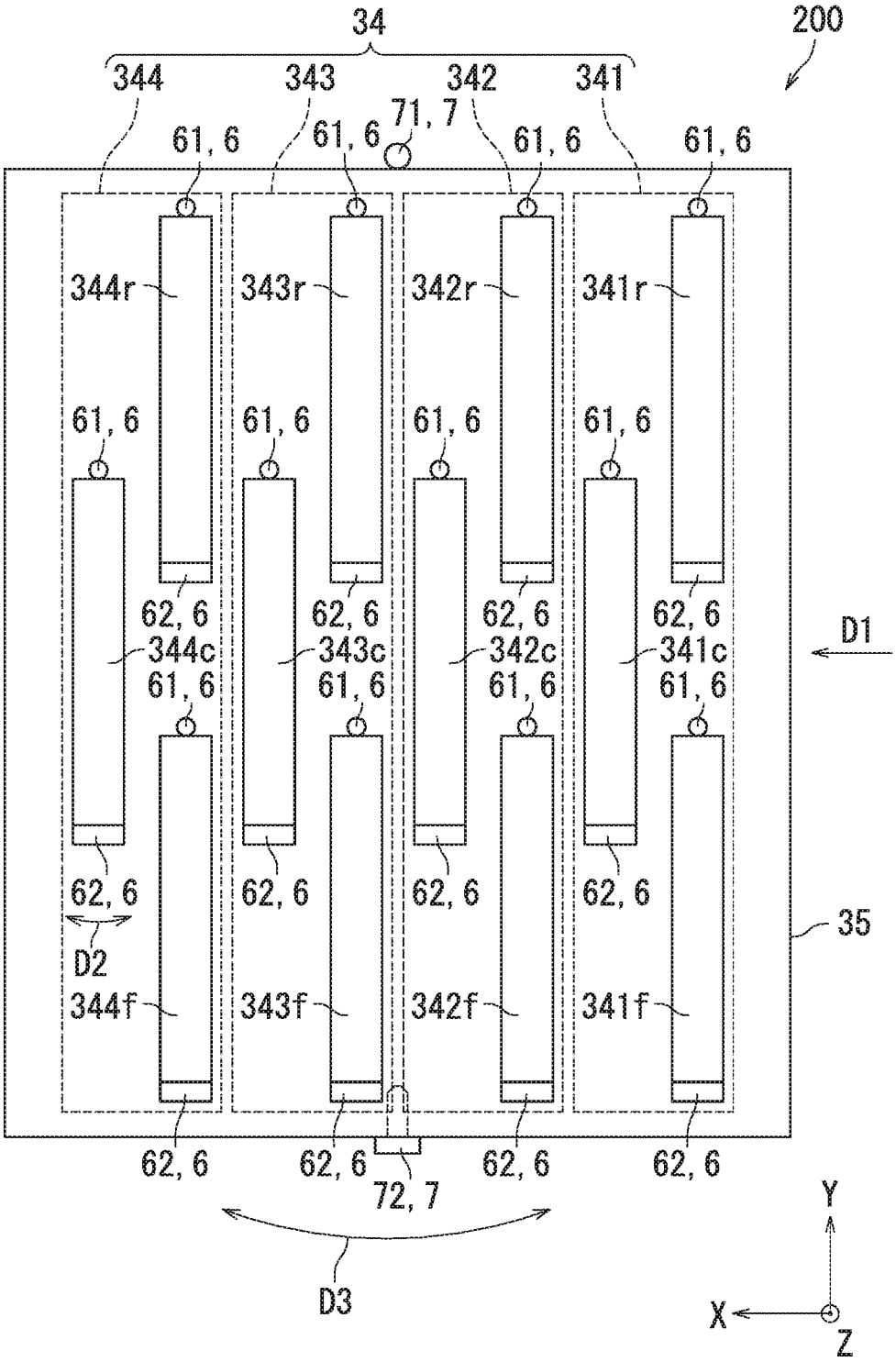
FIG. 2 is a plan view illustrating a configuration of a head section.

Next, a configuration of the head section 200 will be described with reference to FIGS. 1 and 2. FIG. 2 is a plan view illustrating the configuration of the head section 200. As illustrated in FIG. 2, the first recording head 341 includes a segment recording head 341*f*, a segment recording head 341*c*, and a segment recording head 341*r*. The segment recording heads 341*f*, 341*c*, and 341*r* are equivalent to an example of a "plurality of segment recording heads".

The segment recording heads 341*f*, 341*c*, and 341*r* are arranged in a direction (Y axial direction) orthogonal to the conveyance direction D1 of the paper P. Specifically, the segment recording head 341*f* is located on a negative side of the head base 35 in the Y axial direction, the segment recording head 341*c* is located at the center of the head base 35 in the Y axial direction, and the segment recording head 341*r* is located on a positive side of the head base 35 in the Y axial direction.

The second recording head 342 includes a segment recording head 342*f*, a segment recording head 342*c*, and a segment recording head 342*r*. The segment recording heads 342*f*, 342*c*, and 342*r* are equivalent to an example of a "plurality of segment recording heads".

The segment recording heads 342*f*, 342*c*, and 342*r* are arranged in the direction (Y axial direction) orthogonal to the conveyance direction D1 of the paper P. Specifically, the segment recording head 342*f* is located on the negative side of the head base 35 in the Y axial direction, the segment recording head 342*c* is located at the center of the head base 35 in the Y axial direction, and the segment recording head 342*r* is located on the positive side of the head base 35 in the Y axial direction.

The third recording head 343 includes a segment recording head 343*f*, a segment recording head 343*c*, and a segment recording head 343*r*. The segment recording heads 343*f*, 343*c*, and 343*r* are equivalent to an example of a "plurality of segment recording heads".

The segment recording heads 343*f*, 343*c*, and 343*r* are arranged in the direction (Y axial direction) orthogonal to the conveyance direction D1 of the paper P. Specifically, the segment recording head 343*f* is located on the negative side of the head base 35 in the Y axial direction, the segment recording head 343*c* is located at the center of the head base 35 in the Y axial direction, and the segment recording head 343*r* is located on the positive side of the head base 35 in the Y axial direction.

The fourth recording head 344 includes a segment recording head 344*f*, a segment recording head 344*c*, and a segment recording head 344*r*. The segment recording heads 344*f*, 344*c*, and 344*r* are equivalent to an example of a "plurality of segment recording heads".

The segment recording heads 344*f*, 344*c*, and 344*r* are arranged in the direction (Y axial direction) orthogonal to the conveyance direction D1 of the paper P. Specifically, the segment recording head 344*f* is located on the negative side of the head base 35 in the Y axial direction, the segment recording head 344*c* is located at the center of the head base 35 in the Y axial direction, and the segment recording head 344*r* is located on the positive side of the head base 35 in the Y axial direction.

The head section 200 further includes first adjusting members 6. The first adjusting members 6 adjust a longitudinal direction of each of the 12 segment recording heads 34αβ (α=1, 2, 3, 4, β=r, c, f). A first adjusting member 6 is disposed on each of the 12 segment recording heads 34αβ. Each of the first adjusting members 6 has a first support member 61 and a first fixing structure 62. The first adjusting members 6 will be described in detail with reference to FIGS. 4 and 5. The 12 segment recording heads 34αβ are each equivalent to an example of a "recording head".

The head section 200 further includes a second adjusting member 7. The second adjusting member 7 adjusts a position of the head base 35 relative to the casing 1. The second adjusting member 7 has a second support member 71 and a second fixing structure 72. The second adjusting member 7 will be described in detail with reference to FIGS. 6 and 7.

Figure 3:
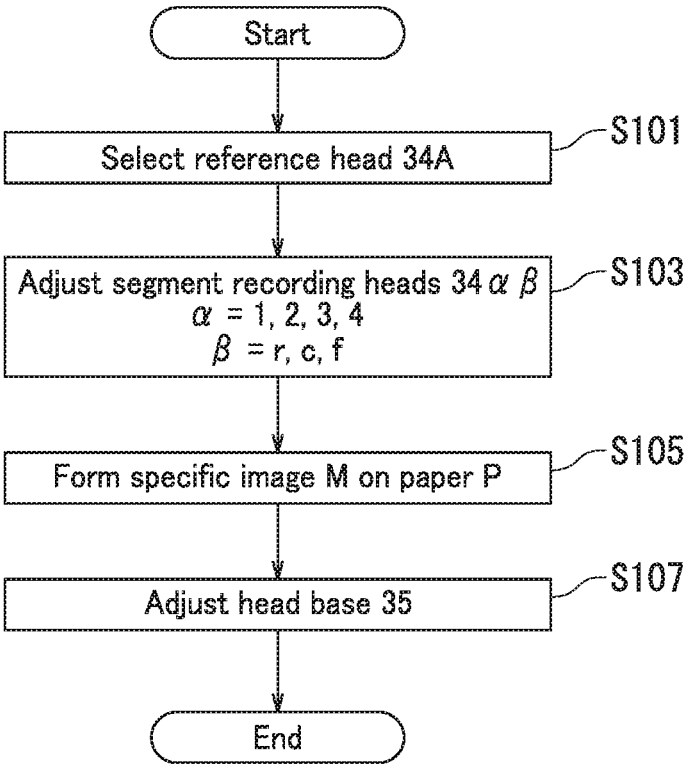
FIG. 3 is a flowchart illustrating a position adjustment method for a recording head.

Next, a position adjustment method for the recording head 34 will be described with reference to FIGS. 1 to 3. FIG. 3 is a flowchart illustrating the position adjustment method for the recording head 34.

As illustrated in FIG. 3, a reference head 34A is first selected in Step S101. Specifically, one segment recording head from the 12 segment recording heads 34αβ (α=1, 2, 3, 4, β=r, c, f) is selected as the reference head 34A. For example, the segment recording head 342*c* is selected as the reference head 34A.

Next, in Step S103, the 11 segment recording heads other than the reference head 34A among the 12 segment recording heads 34αβ (α=1, 2, 3, 4, β=r, c, f) are arranged such that longitudinal directions of the 11 segment recording heads other than the reference head 34A are parallel to a longitudinal direction of the reference head 34A. Specifically, the longitudinal directions of the 11 segment recording heads other than the reference head 34A are adjusted so as to be parallel to the longitudinal direction of the reference head 34A using the first adjusting members 6. The 11 segment recording heads other than the reference head 34A are then fixed to the head base 35 using the first adjusting members 6.

Next, in Step S105, ink is ejected from at least one segment recording head among the 12 segment recording heads 34αβ (α=1, 2, 3, 4, β=r, c, f) to form a specific image M on the paper P. For example, ink is ejected from the reference head 34A to form the specific image M on the paper P. The specific image M will be described in detail with reference to FIG. 8.

Next, in Step S107, the head base 35 is arranged so that the longitudinal direction of the reference head 34A is orthogonal to the conveyance direction D1 of the paper P, and the position adjustment of the recording head 34 ends. Specifically, the position of the head base 35 is adjusted such that the longitudinal direction of the reference head 34A is orthogonal to the conveyance direction D1 of the paper P based on the specific image M using the second adjusting member 7. The head base 35 is then fixed to the casing 1 using the second adjusting member 7.

Step S101 is equivalent to an example of a "selecting". Step S103 is equivalent to an example of "primarily arranging". Step S105 is equivalent to an example of a "forming". Step S107 is equivalent to an example of "secondarily arranging".

According to the embodiment of the present disclosure described above with reference to FIGS. 1 to 3, the 11 segment recording heads other than the reference head 34A among the 12 segment recording heads 34αβ (α=1, 2, 3, 4, β=r, c, f) are arranged such that the longitudinal directions of the 11 segment recording heads other than the reference head 34A are parallel to the longitudinal direction of the reference head 34A. Therefore, the longitudinal directions of the 12 segment recording heads 34αβ can be arranged as parallel to each other. Because the head base 35 is arranged such that the longitudinal direction of the reference head 34A is orthogonal to the conveyance direction D1 of the paper P, the longitudinal directions of the 12 segment recording heads 34αβ can be arranged so as to be orthogonal to the conveyance direction D1 of the paper P. Accordingly, white lines can be inhibited from occurring because the 12 segment recording heads 34αβ can be arranged in appropriate positions. A white line means a line-shaped area in which ink is not deposited. The line-shaped area is formed parallel to the conveyance direction D1 on the paper P.

Note that according to the embodiment of the present disclosure, the segment recording head 342*c* is selected as the reference head 34A, but the present disclosure is not limited hereto. Any one of the 12 segment recording heads 34αβ (α=1, 2, 3, 4, β=r, c, f) may be selected as the reference head 34A.

A segment recording head located at an approximate center of the head base 35 in the Y axial direction and the X axial direction is preferably selected as the reference head 34A. Due to the selection of the reference head 34A in this way, a maximum distance between the reference head 34A and the 11 segment recording heads other than the reference head 34A can be shortened. Accordingly, the longitudinal directions of the 11 segment recording heads other than the reference head 34A can be easily adjusted so as to be parallel to the longitudinal direction of the reference head 34A.

Figure 4:
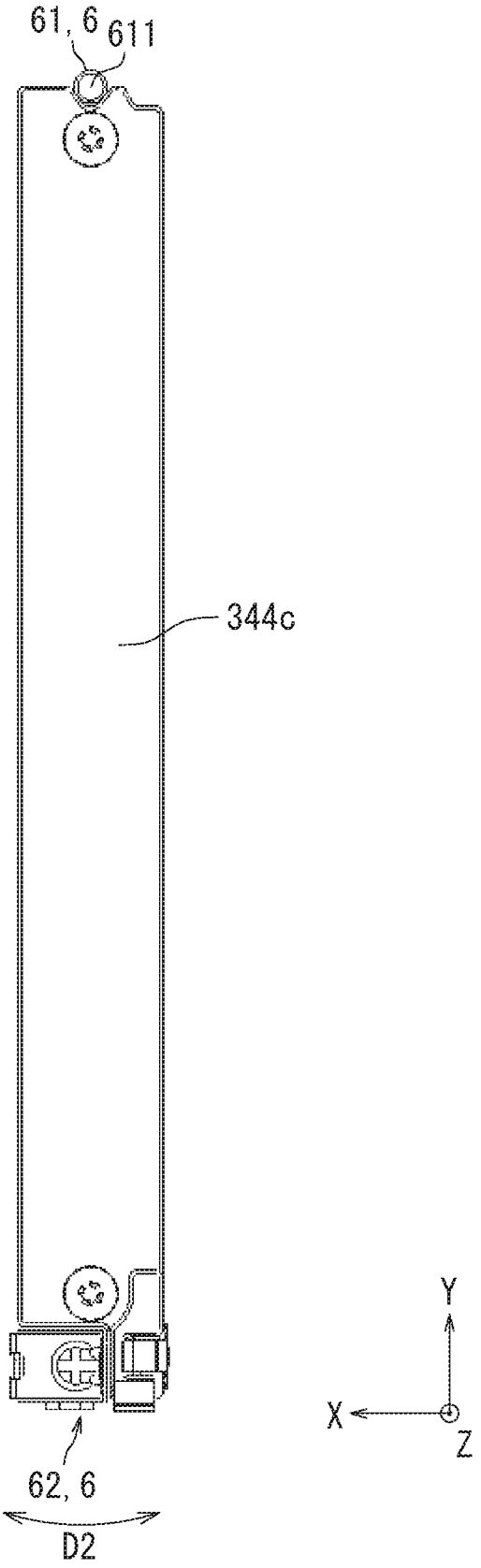
FIG. 4 is a plan view illustrating a configuration of a first adjusting member.

Next, a configuration of each first adjusting member 6 will be described with reference to FIGS. 2, 4, 5A, and 5B. FIG. 4 is a plan view illustrating the configuration of the first adjusting member 6. The first adjusting member 6 has the first support member 61 and the first fixing structure 62. The first fixing structure 62 is equivalent to an example of a "first fixing member".

Because the 12 segment recording heads 34αβ (α=1, 2, 3, 4, β=r, c, f) illustrated in FIG. 2 have substantially the same configuration, the segment recording head 344*c* will be described as follows and description of the other segment recording heads will be omitted.

As illustrated in FIG. 4, the segment recording head 344*c* extends in the Y axial direction. That is, a longitudinal direction of the segment recording head 344*c* is substantially parallel to the Y axial direction. The first support member 61 pivotably supports one end of the segment recording head 344*c* in the longitudinal direction thereof (positive end in the Y axial direction) relative to the head base 35. Specifically, the first support member 61 includes a substantially cylindrical rotary shaft 611. The rotary shaft 611 is arranged parallel to a Z axial direction on the head base 35. The segment recording head 344*c* is supported by the head base 35 so as to be pivotable around the rotary shaft 611.

The first fixing structure 62 is configured such that a position of the other end of the segment recording head 344*c* in the longitudinal direction thereof (negative end in the Y axial direction) is adjustable in a direction D2. Specifically, the direction D2 indicates a pivot direction of the other end of the segment recording head 344*c* in the longitudinal direction thereof when the segment recording head 344*c* pivots around the rotary shaft 611. The first fixing structure 62 fixes the other end of the segment recording head 344*c* in the longitudinal direction thereof to the head base 35.

Figure 5A:
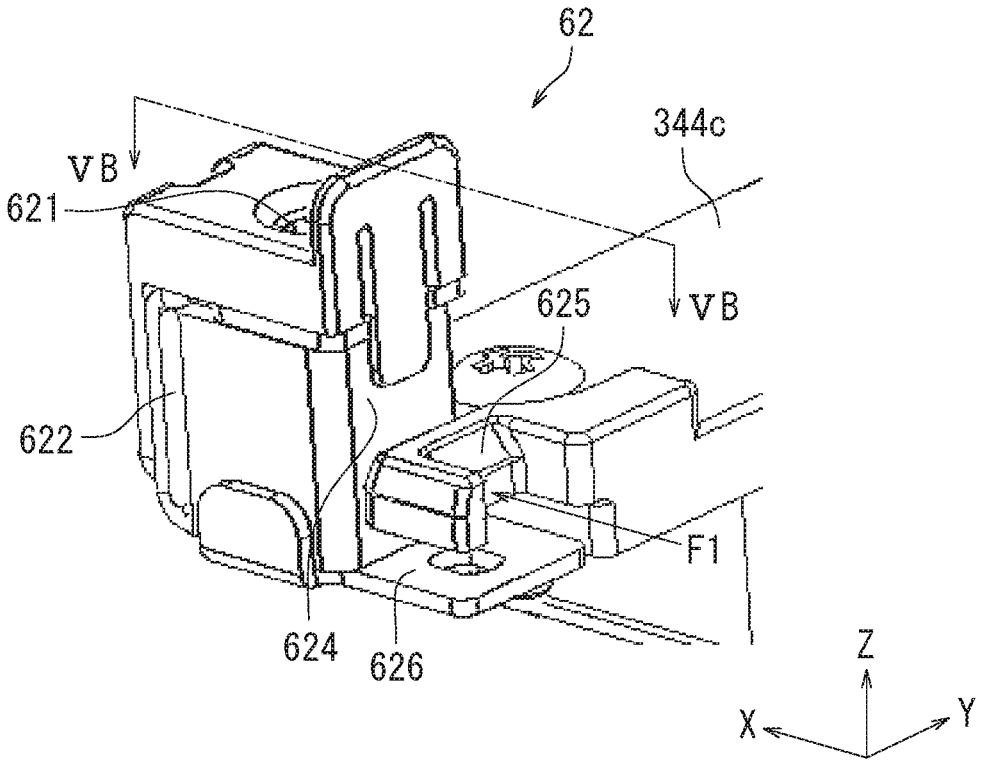
FIGS. 5A and 5B are diagrams illustrating a configuration of a first fixing member.
Figure 5B:
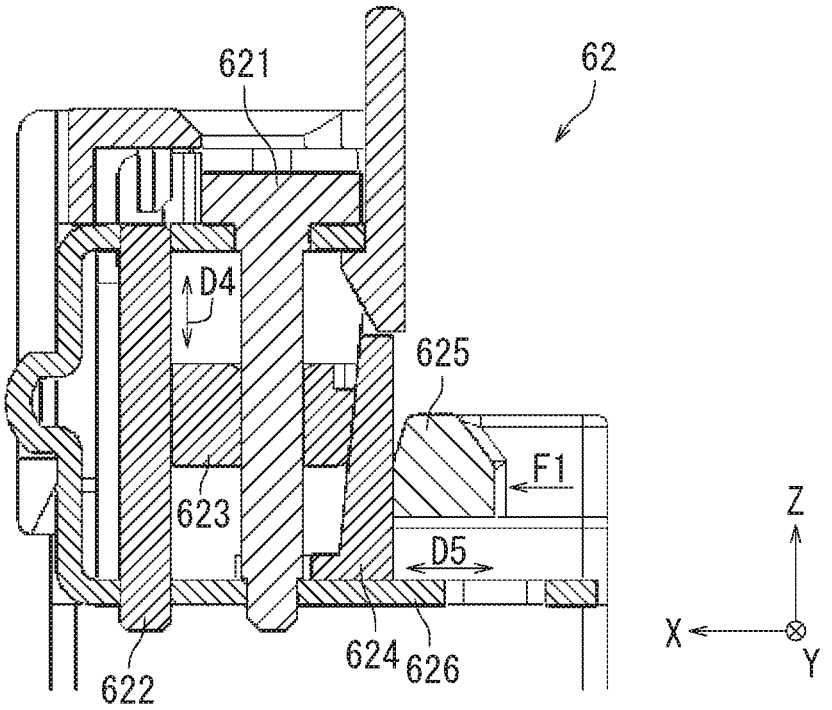

FIGS. 5A and 5B are diagrams illustrating a configuration of the first fixing structure 62. FIG. 5A is a perspective view illustrating the first fixing structure 62. FIG. 5B is a cross-sectional view of the first fixing structure 62 taken along line VB-VB in FIG. 5A. As illustrated in FIG. 5A, the first fixing structure 62 includes an adjusting member 621, a supporting member 622, a moving member 624, a contacting member 625, and a plate-shaped member 626.

The contacting member 625 is fixed to the other end of the segment recording head 344*c* in the longitudinal direction thereof (negative end in the Y axial direction). The contacting member 625 is also urged in a direction F1 (positive direction of the X axis). The plate-shaped member 626 is fixed to the head base 35.

As illustrated in FIG. 5B, the first fixing structure 62 additionally includes a lifting member 623. The adjusting member 621 has a screw shape. A center axis of the adjusting member 621 is arranged in the Z axial direction. A user rotates the adjusting member 621 when adjusting the position of the other end of the segment recording head 344*c* in the longitudinal direction thereof (negative end in the Y axial direction).

The supporting member 622 is plate-shaped and arranged along a Y-Z plane. Specifically, the supporting member 622 is fixed to the plate-shaped member 626. That is, the supporting member 622 is fixed to the head base 35 through the plate-shaped member 626. The supporting member 622 also slidably supports one end (positive end in the X axial direction) of the lifting member 623.

The lifting member 623 has a screw hole with the adjusting member 621 screwed therein, and ascends and descends in a direction D4 (Z axial direction) according to the rotation of the adjusting member 621. The one end (positive end in the X axial direction) of the lifting member 623 slides on one surface (negative side surface in the X axial direction) of the supporting member 622. The other end (negative end in the X axial direction) of the lifting member 623 slides on one surface (positive side surface in the X axial direction) of the moving member 624.

The moving member 624 is located between the lifting member 623 and the contacting member 625, and moves in a direction D5 (X axial direction) according to the ascending and descending of the lifting member 623. Specifically, the moving member 624 moves in the negative direction of the X axis as the lifting member 623 descends. The moving member 624 also moves in the positive direction of the X axis as the lifting member 623 ascends.

Next, operation of the first fixing structure 62 will be described. The lifting member 623 moves in the negative direction of the Z axis as the user rotates the adjusting member 621 in a specific direction (clockwise, for example). The moving member 624 then moves in the negative direction of the X axis according to the movement of the lifting member 623 in the negative direction of the Z axis because the one surface (positive side surface in the X axial direction) of the moving member 624 is slanted in the positive direction of the X axial direction toward the negative direction of the Z axis (diagonally to the lower left). The contacting member 625 then moves in the negative direction of the X axis, and the other end of the segment recording head 344*c* in the longitudinal direction thereof moves in the negative direction of the X axis.

The lifting member 623 moves in the positive direction of the Z axis as the user rotates the adjusting member 621 counterclockwise. The moving member 624 then moves in the positive direction of the X axis according to the movement of the lifting member 623 in the positive direction of the Z axis. The contacting member 625 then moves in the positive direction of the X axis, and the other end of the segment recording head 344*c* in the longitudinal direction thereof moves in the positive direction of the X axis.

The adjusting member 621, the supporting member 622, the lifting member 623, and the moving member 624 are integrally fixed to the head base 35 through the plate-shaped member 626 when the adjusting member 621 does not rotate. The contacting member 625 is urged in the direction F1 (positive direction of the X axis). Therefore, the contacting member 625 is fixed in a state of contact with the moving member 624. Accordingly, the first fixing structure 62 fixes the other end of the segment recording head 344*c* in the longitudinal direction thereof to the head base 35.

According to the embodiment of the present disclosure as described above with reference to FIGS. 2, 4, 5A, and 5B, the user can adjust the position of the other end of the segment recording head 344*c* in the longitudinal direction thereof (negative end in the Y axial direction) by rotating the adjusting member 621. In a manufacturing process of the inkjet recording apparatus 100 for example, the position of the segment recording head 344*c* is observed with a video camera and confirmed to be parallel to the reference head 34A or not. Also for example, the segment recording head 344*c* is confirmed to be parallel to the reference head 34A or not by forming an image for confirming on the paper P when in use by the user (after the inkjet recording apparatus 100 has been shipped). Accordingly, the longitudinal direction of the segment recording head 344*c* can be easily arranged parallel to the reference head 34A.

The contacting member 625 is fixed in a state of contact with the moving member 624 by stopping rotation of the adjusting member 621. Accordingly, the first fixing structure 62 can fix the other end of the segment recording head 344*c* in the longitudinal direction thereof.

Note that according to the embodiment of the present disclosure, the first support member 61 is located on the one end of the segment recording head 344*c* in the longitudinal direction thereof (positive end in the Y axial direction), and the first fixing structure 62 is located on the other end of the segment recording head 344*c* in the longitudinal direction thereof (negative end in the Y axial direction). However, the present disclosure is not limited hereto. The first support member 61 may be located on the other end of the segment recording head 344*c* in the longitudinal direction thereof, and the first fixing structure 62 may be located on the one end of the segment recording head 344*c* in the longitudinal direction thereof.

Figure 6:
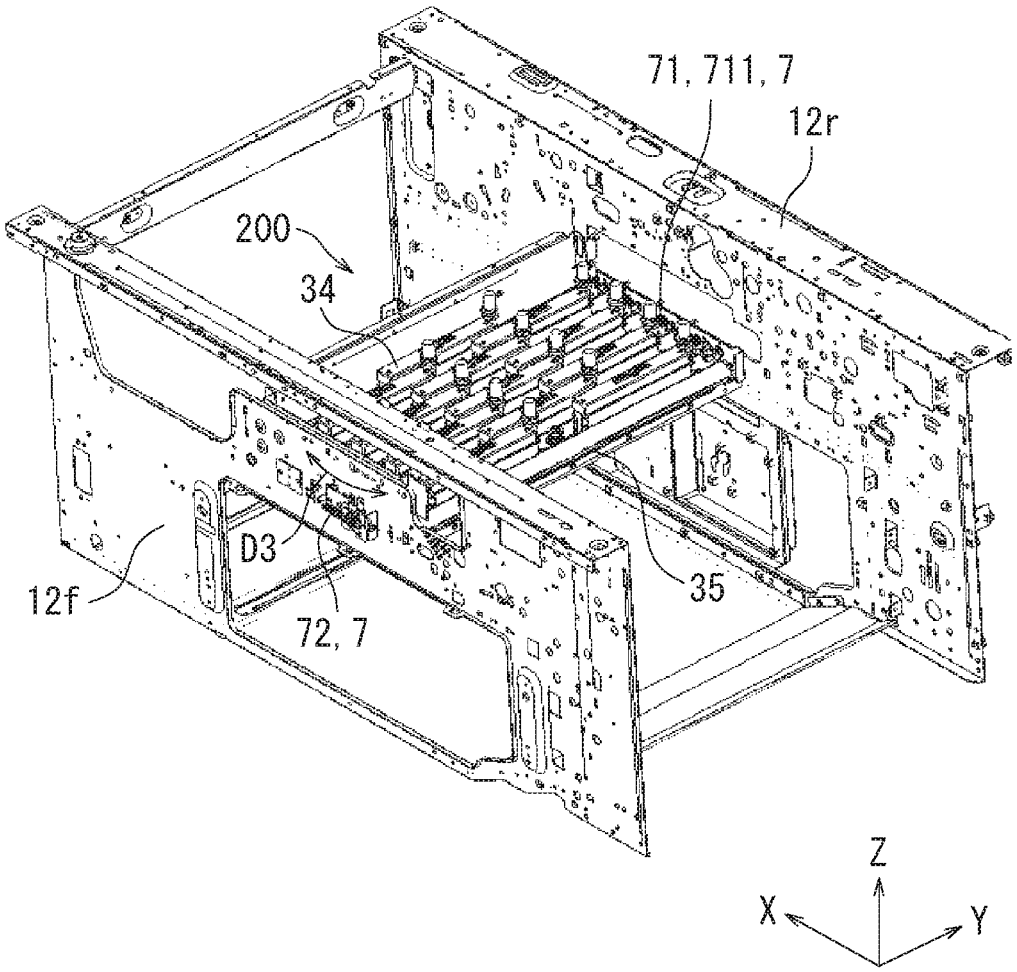
FIG. 6 is a perspective view illustrating an attached state of a head base to a casing.

Next, a configuration of the second adjusting member 7 will be described with reference to FIGS. 2, 6, and 7. FIG. 6 is a perspective view illustrating an attached state of the head base 35 to the casing 1. As illustrated in FIG. 6, the casing 1 further includes a side plate 12*r* and a side plate 12*f*.

The side plate 12*r* has a plate shape and is arranged parallel to the X-Z plane on a positive side of the casing 1 in the Y axial direction. The side plate 12*r* supports one end of the head base 35 (positive end in the Y axial direction).

The side plate 12*f* has a plate shape and is arranged parallel to the X-Z plane on a negative side of the casing 1 in the Y axial direction. The side plate 12*f* supports the other end of the head base 35 (negative end in the Y axial direction).

The second adjusting member 7 has the second support member 71 and the second fixing structure 72. The second fixing structure 72 is equivalent to an example of a "second fixing member".

The second support member 71 is located between the head base 35 and the side plate 12*r*. The second support member 71 supports the head base 35 such that the head base 35 is pivotable relative to the side plate 12*r*. Specifically, the second support member 71 includes a substantially cylindrical rotary shaft 711. The rotary shaft 711 is arranged parallel to the Z axial direction on the side plate 12*r*. The head base 35 is supported by the side plate 12*r* so as to be pivotable around the rotary shaft 711.

The second fixing structure 72 is configured such that the other end of the head base 35 (negative end in the Y axial direction) is adjustable in a direction D3. The direction D3 indicates a direction in which the other end of the head base 35 pivots when the head base 35 pivots around the rotary shaft 711. The second fixing structure 72 fixes the other end of the head base 35 to the side plate 12*f*.

Figure 7:
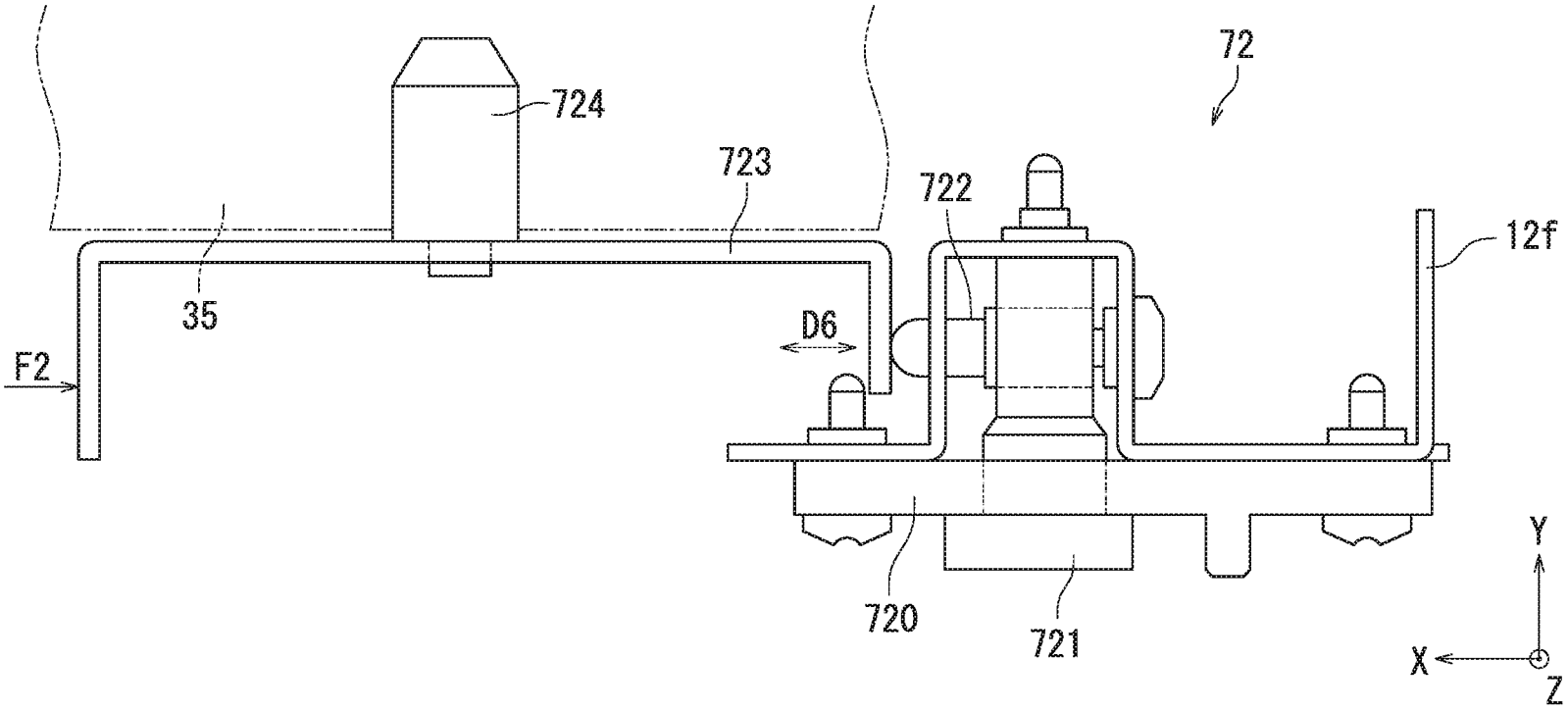
FIG. 7 is a plan view illustrating a configuration of a second fixing member.

FIG. 7 is a plan view illustrating a configuration of the second fixing structure 72. As illustrated in FIG. 7, the second fixing structure 72 includes a first plate-shaped member 720, an adjusting member 721, a moving member 722, a second plate-shaped member 723, and a locking member 724.

The first plate-shaped member 720 is plate-shaped and is fixed to the side plate 12*f*. The first plate-shaped member 720 is arranged parallel to the X-Z plane.

The adjusting member 721 is cylindrical and has teeth (cylindrical worm) on the outer circumference thereof. A center axis of the adjusting member 721 is arranged in the Y axial direction. A user rotates the adjusting member 721 when adjusting the position of the other end (negative end in the Y axial direction) of the head base 35.

The moving member 722 is cylindrical and has teeth helically arranged on an outer circumferential surface thereof. A center axis of the moving member 722 is arranged in the X axial direction. The moving member 722 and the adjusting member 721 are configured as so-called "worm gears". That is, the moving member 722 moves in a direction D6 (X axial direction) as the adjusting member 721 rotates.

The second plate-shaped member 723 is plate-shaped and integrated with the locking member 724. The second plate-shaped member 723 is fixed to a surface of the other end (negative end in the Y axial direction) of the head base 35 and arranged in the X axial direction. One end (negative end in the X axial direction) of the second plate-shaped member 723 is in contact with the moving member 722. The other end (positive end in the X axial direction) of the second plate-shaped member 723 is urged in a direction F2 (negative direction of the X axis).

The locking member 724 is cylindrical and is fixed to the other end of the head base 35. Specifically, the other end (negative end in the Y axial direction) of the head base 35 has a round hole extending in the Y axial direction. The locking member 724 is inserted into the hole in the other end of the head base 35 and is fixed to the head base 35. That is, the second plate-shaped member 723 and the locking member 724 are integrated with the head base 35.

Next, operation of the second fixing structure 72 will be described. The moving member 722 moves in the positive direction of the X axis as the user rotates the adjusting member 721 in a specific direction (clockwise, for example). The second plate-shaped member 723 and the locking member 724 then move in the positive direction of the X axis and the other end of the head base 35 moves in the positive direction of the X axis according to the movement of the moving member 722 in the positive direction of the X axis.

The moving member 722 moves in the negative direction of the X axis as the user rotates the adjusting member 721 counterclockwise. The second plate-shaped member 723 and the locking member 724 move in the negative direction of the X axis according to the movement of the moving member 722 in the negative direction of the X axis because the second plate-shaped member 723 is urged in the direction F2 (negative direction of the X axis). The other end (negative end in the Y axial direction) of the head base 35 then moves in the negative direction of the X axis.

The adjusting member 721 and the moving member 722 are integrally fixed to the side plate 12*f* through the first plate-shaped member 720 when the adjusting member 721 is not rotated. The second plate-shaped member 723 is urged in the direction F2 (negative direction of the X axis). Therefore, the second plate-shaped member 723 is fixed in a state of contact with the moving member 722. Accordingly, the second fixing structure 72 fixes the other end (negative end in the Y axial direction) of the head base 35 to the side plate 12*f*.

According to the embodiment of the present disclosure as described above with reference to FIGS. 2, 6, and 7, the user can adjust the position of the other end (negative end in the Y axial direction) of the head base 35 by rotating the adjusting member 721. Accordingly, the head base 35 can be easily arranged such that the longitudinal direction of the reference head 34A is orthogonal to the conveyance direction D1 of the paper P.

The second plate-shaped member 723 is fixed in a state of contact with the moving member 722 by stopping the rotation of the adjusting member 721. Accordingly, the second fixing structure 72 can fix the other end of the head base 35 to the side plate 12*f*.

Note that according to the embodiment of the present disclosure, the second support member 71 is located on the one end (positive end in the Y axial direction) of the head base 35, and the second fixing structure 72 is located on the other end (negative end in the Y axial direction) of the head base 35. However, the present disclosure is not limited hereto. The second support member 71 may be located on the other end of the head base 35, and the second fixing structure 72 may be located on the one end of the head base 35.

Figure 8:
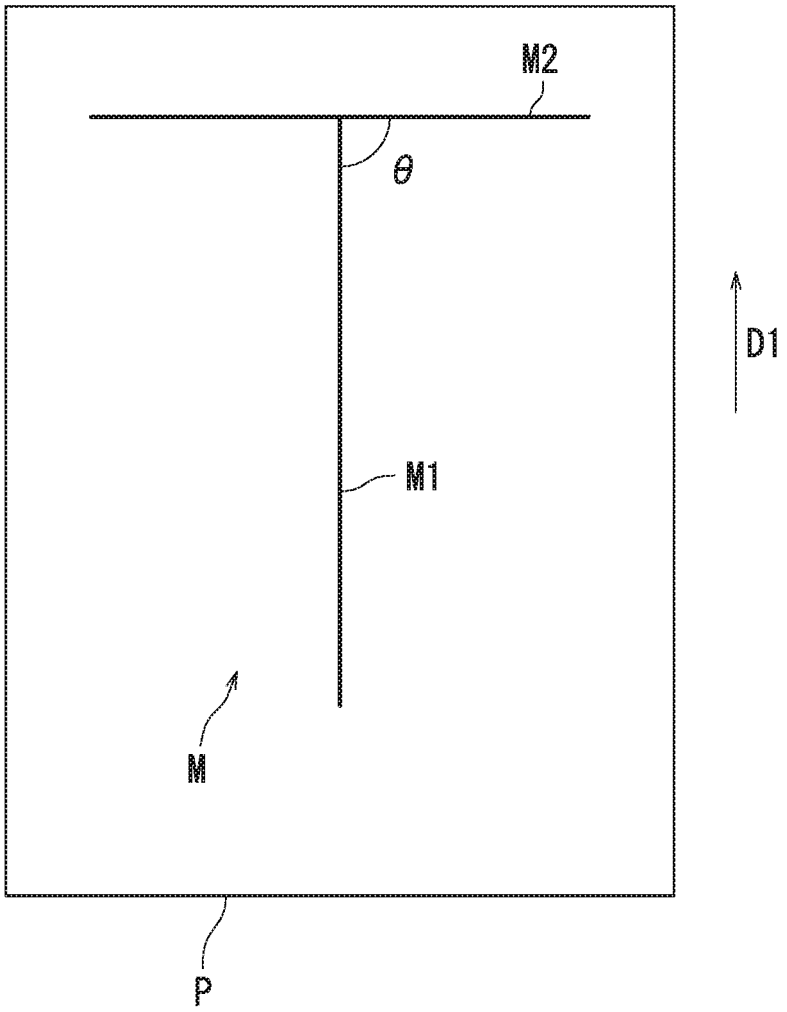
FIG. 8 is a diagram illustrating a specific image.

Next, a position adjustment method for the head base 35 will be described in detail with reference to FIGS. 1 to 3 and 6 to 8. FIG. 8 is a diagram illustrating the specific image M. As illustrated in FIG. 8, the specific image M includes a first image M1 and a second image M2.

The first image M1 extends in a direction parallel to the conveyance direction D1 of the paper P. Specifically, the first image M1 is a linear image extending in a direction parallel to the conveyance direction D1 of the paper P. The second image M2 is a linear image parallel to the longitudinal direction of the reference head 34A. An angle θ indicates an angle between the first image M1 and the second image M2.

As described above with reference to FIG. 3, the position of the head base 35 is adjusted so that the longitudinal direction of the reference head 34A is orthogonal to the conveyance direction D1 of the paper P based on the specific image M.

Specifically, the first image M1 is parallel to the conveyance direction D1 of the paper P. The second image M2 is parallel to the longitudinal direction of the reference head 34A. For example, the user moves the other end of the head base 35 in the positive direction of the X axis by rotating the adjusting member 721 (refer to FIG. 8) in a specific direction (clockwise, for example) when the angle θ is acute. Thus, the angle θ can be increased.

For another example, the user moves the other end of the head base 35 in the negative direction of the X axis by rotating the adjusting member 721 counterclockwise when the angle θ is obtuse. Thus, the angle θ can be decreased. In this way, the user can adjust the position of the other end (negative end in the Y axial direction) of the head base 35 such that the angle θ is a right angle by rotating the adjusting member 721.

According to the embodiment of the present disclosure as described above with reference to FIGS. 1 to 3 and 6 to 8, the position of the head base 35 can be adjusted so that the longitudinal direction of the reference head 34A is orthogonal to the conveyance direction D1 of the paper P by arranging the head base 35 such that the first image M1 and the second image M2 are orthogonal (the angle θ is a right angle). Accordingly, the position of the head base 35 can be easily adjusted.

The embodiment of the present disclosure has been described above with reference to the drawings. However, the present disclosure is not limited to the above-mentioned embodiment and may be implemented in various manners within a scope not departing from the gist thereof (as below in (1) to (2), for example). The drawings are schematic illustrations that emphasize elements of configuration in order to facilitate understanding thereof. Properties of the elements of configuration illustrated in the drawings, such as thickness, length, and number thereof, may differ from actual properties thereof in order to facilitate preparation of the drawings. Properties of the elements of configuration illustrated in the above-mentioned embodiment such as shape and size are one example, not particularly limited, and may be variously altered within a scope not substantially departing from the effects of the present disclosure.

(1) According to the present embodiment as described with reference to FIGS. 1 and 2, the inkjet recording apparatus 100 includes four recording heads (first to fourth recording heads 341 to 344). However, the present disclosure is not limited hereto. The inkjet recording apparatus 100 may include any number of recording heads greater than one. For example, the number of recording heads in the inkjet recording apparatus 100 may be two or three. Also for example, the number of recording heads in the inkjet recording apparatus 100 may be five or more.

(2) According to the present embodiment as described with reference to FIGS. 1 and 2, each of the first to fourth recording heads 341 to 344 includes three segment recording heads. However, the present disclosure is not limited hereto. Each of the first to fourth recording heads 341 to 344 need not be divided into multiple segment recording heads. Also, each of the first to fourth recording heads 341 to 344 may be divided into any number of segment recording heads.

What is claimed is:

1. An inkjet recording apparatus, comprising:

a plurality of recording heads configured to eject ink on to a recording medium;

a head base supporting the recording heads;

a conveyor belt arranged opposite to the recording heads and configured to convey the recording medium in a conveyance direction of the recording medium;

a casing which houses the recording heads, the head base, and the conveyor belt; and a second adjusting member configured to adjust a position of the head base, wherein one recording head among the plurality of recording heads is selected as a reference head, the recording heads other than the reference head among the plurality of recording heads are arranged such that longitudinal directions of the recording heads other than the reference head are parallel to a longitudinal direction of the reference head, the head base is arranged such that the longitudinal direction of the reference head is orthogonal to the conveyance direction of the recording medium, the head base is attached to the casing, the second adjusting member has a second support member and a second fixing member, the second support member supports one end of the head base in a direction orthogonal to the conveyance direction of the recording medium such that the head base is pivotable around an axis perpendicular to a recording surface of the recording medium, and the second fixing member allows another end of the head base in the direction orthogonal to the conveyance direction of the recording medium to be adjusted in a direction parallel to the conveyance direction of the recording medium and fixes the other end of the head base to the casing.

2. The inkjet recording device according to claim 1, wherein the recording heads include:

a first recording head configured to eject an ink of a first color;

a second recording head configured to eject an ink of a second color;

a third recording head configured to eject an ink of a third color; and a fourth recording head configured to eject an ink of a fourth color, the first recording head, the second recording head, the third recording head, and the fourth recording head each include a plurality of segment recording heads, the first color, the second color, the third color, and the fourth color are different from each other, and the segment recording heads are arranged in a direction orthogonal to the conveyance direction of the recording medium.

3. The inkjet recording apparatus according to claim 1, further comprising:

first adjusting members configured to adjust the longitudinal directions of the respective recording heads, wherein each of the first adjusting members has a first support member and a first fixing member, the first support member supports one end of the corresponding recording head in the longitudinal direction thereof such that the corresponding recording head is pivotable around an axis perpendicular to the head base, and the first fixing member allows a position of another end of the corresponding recording head in the longitudinal direction thereof to be adjusted in a direction parallel to the conveyance direction of the recording medium and fixes the other end of the corresponding recording head to the head base.

4. The inkjet recording apparatus according to claim 3, wherein the first fixing member has:

an adjusting member with a screw shape;

a lifting member configured to receive the adjusting member screwed therein, and ascend and descend according to rotation of the adjusting member;

a moving member configured to move in a direction parallel to the conveyance direction of the recording medium according to the ascending and descending of the lifting member;

a contacting member fixed to the other end of the corresponding recording head and urged so as to be in contact with the moving member.

5. The inkjet recording apparatus according to claim 1, wherein the second fixing member includes:

a first plate-shaped member fixed to the casing;

an adjusting member rotatably disposed on the first plate-shaped member;

a moving member configured to move in a direction parallel to the conveyance direction of the recording medium according to rotation of the adjusting member;

a locking member fixed to the other end of the head base; and a second plate-shaped member integrated with the locking member, and the second plate-shaped member is urged in a direction in which the second plate-shaped member is in contact with the moving member.

6. The inkjet recording apparatus according to claim 1, wherein the reference head is located at a center of the head base.

7. The ink jet recording apparatus according to claim 1, further comprising a first adjusting member configured to adjust the longitudinal direction of the reference head, wherein the first adjusting member has a first support member and a first fixing member, the first support member supports one end of the reference head in the longitudinal direction thereof such that the reference head is pivotable around an axis perpendicular to the head base, and the first fixing member allows a position of another end of the reference head in the longitudinal direction thereof to be adjusted in a direction parallel to the conveyance direction of the recording medium and fixes the other end of the reference head to the head base.

8. The ink jet recording apparatus according to claim 1, wherein among the recording heads, the reference head is a recording head located on a forward side of the head base in the conveyance direction of the recording medium, or is a recording head located on a backward side of the head base in the conveyance direction of the recording medium.

9. The inkjet recording apparatus according to claim 1, wherein the recording medium is paper.

* * * * *